United States Patent [19]

Kunisada et al.

[11] 3,995,452

[45] Dec. 7, 1976

[54] HAND KNITTING MACHINE

[75] Inventors: Masaaki Kunisada, Anjo; Masao Itou, Toyota, both of Japan

[73] Assignee: Aisin Seiki Kabushiki Kaisha, Kariya, Japan

[22] Filed: Nov. 13, 1975

[21] Appl. No.: 631,661

Related U.S. Application Data

[63] Continuation of Ser. No. 577,679, May 15, 1975, abandoned.

[30] Foreign Application Priority Data

| | | |
|---|---|---|
| May 24, 1974 | Japan | 49-59159 |
| June 10, 1974 | Japan | 49-65730 |
| Aug. 8, 1974 | Japan | 49-91276 |

[52] U.S. Cl. ..... 66/64

[51] Int. Cl.[2] ..... D04B 7/04

[58] Field of Search ..... 66/64, 75, 64 X, 60, 66/604, 154

[56] References Cited

UNITED STATES PATENTS

| | | | |
|---|---|---|---|
| 3,120,114 | 2/1964 | Sasaki | 68/604 |
| 3,225,568 | 12/1965 | Tanaka | 68/604 |
| 3,783,641 | 1/1974 | Kitazawa | 66/64 |

*Primary Examiner*—Ronald Feldbaum

*Attorney, Agent, or Firm*—Pierce, Scheffler & Parker

[57] ABSTRACT

A hand knitting machine having a needle bed, a series of sinkers extending from the front edge of the needle bed, a series of corresponding number of latch needles alternated with the sinkers, an actuator movably supported on the needle bed, and needle selecting means. The needle selecting means has a central sinker on the actuator and at either side of the sinker a selecting cam having a duplicatedly inclined acting cam face inwardly backwardly of the actuator. The needle selecting means further has a control means to selectively restrain the needles from being subject to the selecting cam, whereby all the needle are divided into two groups each time the actuator travels in either direction on the needle bed.

8 Claims, 24 Drawing Figures

HAND KNITTING MACHINE

This is a continuation of application Ser. No. 577,679, filed May 15, 1975, now abandoned.

BACKGROUND OF THE INVENTION

This invention relates to knitting and in particular to method and apparatus adapted to the known household type hand knitting machine having a series of latch needles axially slidable on a needle bed and an actuator or carriage movably supported on the needle bed.

It has been known in the art that a knitting pattern is obtained in the character of the product which is needed by dividing any number of needles apart from the series of the needles and rendering the divided needles inoperative in forming the meshes or operable in forming different meshes. In order to achieve this, it has been conventional that a considerably complicated device is employed and accordingly an entire capacity of the machine is undesirably enlarged. This deficiency is considered to be a disadvantage in substantial saving the manufacturing costs and in achieving a simpler operation by the operators.

SUMMARY OF THE INVENTION

A principal object of the present invention therefore is to provide an actuator and its associated devices of the hand knitting machine of household type for dividing a series of needles into two series of needles in accordance with an intended knitting pattern in the character of the product which is needed without structural complication in the machine.

The foregoing object and others are attained according to at least one aspect of the present invention through the provision of a selecting cam assembly on the actuator which develops two-way or dimensionally different two side thrusts against the needle butts and control means to selectively restrain the needle butts from being subject to a first side thrust which serves to sink the needles while permitting the needles to be subject to a second side thrust which serves to depress the needles with the result that the needles are not sunk and division of the needles is achieved.

Thus in the disclosed embodiments, there are provided a needle bed, a series of sinkers forwardly extending from the front side edge of the needle bed and arranged in parallel each other and at regular intervals in a plane, a series of latch needles alternated with the sinkers and having a slide fit on the needle bed so as to project beyond and retract from the neighboring sinkers, an actuator or carriage movably supported above the needle bed so as to reciprocate along the longitudinal direction of the needle bed and engage with said needles to have the needles project beyond and retract behind the sinkers to form the stitches, and needle selecting means. The actuator has a base plate, central sinker cam means on the base plate and a selecting cam assembly at either side of the central sinker cam means in symmetric relation to the center line of the central sinker cam means. Each of the selecting cam assembly comprises a selecting cam formed with a cam face inclined inwardly and backwardly of the actuator, a latch rotatingly spring operated to restrain the needle butts from being subject to the first side thrust while permitting to be subject to the second side thrust, and a lifting cam to lift and join the needles remaining in the divisional sunk series with the other original series together for subjection to the selecting cam. The control means includes a series of selecting sheets arranged side by side in slidably contacting relation to each other, each sheet being formed with along one side edge thereof a series of projections at regular intervals, in somewhat like a hair comb form. Arrangement of the sheets is such that all the projections are offset exactly one pitch of the needles relative to the neighboring projections of different sheets in successive steps to the arrangement order of the sheets, so that different needles engage different sheets through means of the projections except that the same sheet engages different needles spaced at the same distance as that between the two neighboring projections of that same sheet.

The control means further includes a driving device comprising a pair of levers and connecting links which are urged by a spring to normally follow a rectangular form and a pawl pivoted to the actuator and normally urged by a spring to sideward abutment against the link at an acute angle thereto with the free end thereof in pivotal engagement with the link during the first half of the swing of the pawl and sliding idling contact with the link during the subsequent half of the swing.

The control means still further includes means to connect the selecting sheets selectively to the link of the drive means. Such connecting means includes a punched card carried on a roller to be travelled, transmitting means operatively connected to the drive means, and a series of conjunction members identical in number with the selecting sheets and engaging normally the corresponding one of the selecting sheets while selectively engaging the transmitting means in dependency upon presence of signals in the punched card. The punched card is supplemented by manually operable push buttons as to the signal.

DESCRIPTION OF THE PREFERRED EMBODIMENTS

Throughout the drawng, similar numerals refer to similar parts of the machine according to the present invention.

Figure 1:
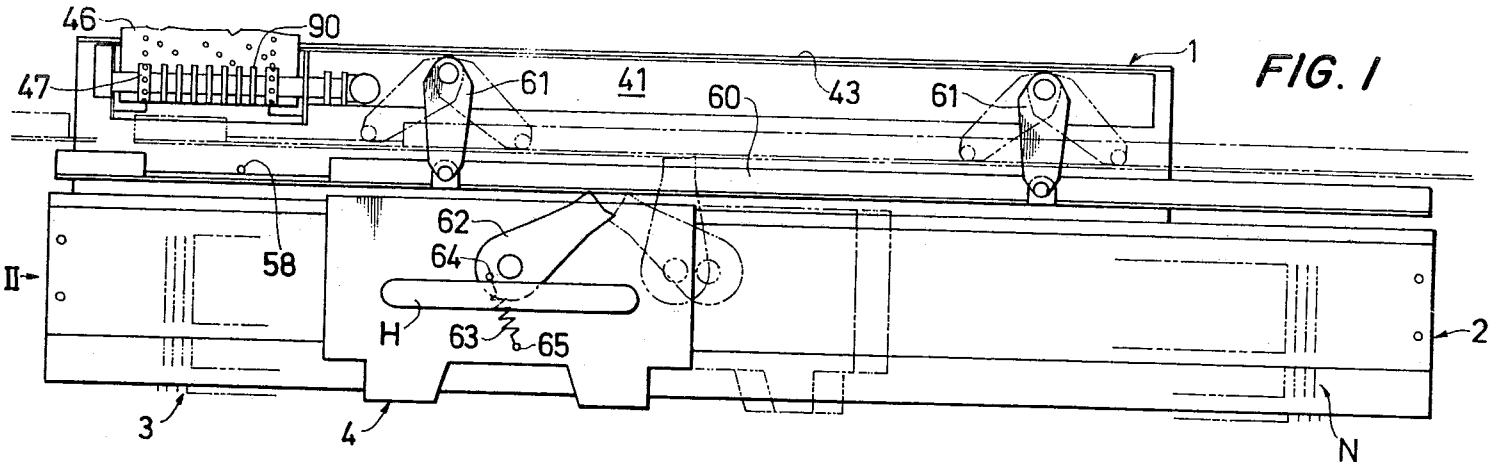
FIG. 1 is a plan view of a household type hand knitting machine according to the present invention.

Referring to FIG. 1, a hand-knitting machine 1 includes a needle bed 2 and a large number of sinkers 3 forwardly protruding from the front extremity of the needle bed 2 and being arranged parallel and at regular intervals in a horizontal lane. A corresponding number of latch needles N are alternated with the sinkers 3 in that plane and have a free slide fit in the respective slots in the needle bed as will be described in detail as the description proceeds. An actuator 4 of the present invention is a sliding fit on the needle bed to be laterally reciprocated by the operator when the machine is used in actual knitting operation. For that purpose, the actuator 4 is provided with an upright handle H in convenient reach of the operator. The actuator is free to slide on a pair of paralle guide rails 5 and 6 on the needle bed as shown in FIG. 2

Figure 2:
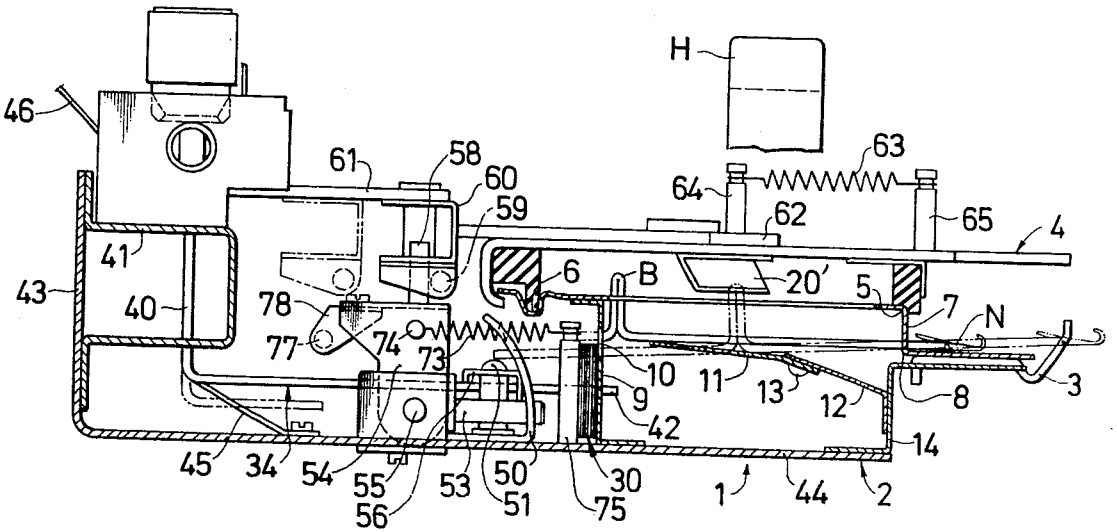
FIG. 2 is a side view viewed along the arrow II at the left in FIG. 1.

As will be seen in FIG. 2, the needle bed 2 is formed with in the front wall 7 a series of slots 8 and in the back wall 9 another series of similar slots 10. Each needle N is free to slide in a pair of corresponding slots 8 and 10, with the butt also slidably received in a slot in the upper wall of the needle bed 2. The butt, as indicated by the reference character B in FIG. 2 is thus kept upright exactly in the arrangement. It should be noted that each slot 10 is slightly elongated in excess of an actually required size to permit the needles to axially move so that the slot 10 provides a clearance for the needle to move in an imaginable vertical plane. The needle N in each slot 10 is normally spring-biased toward abutment against the upper end of slot 10 to be held in the position shown in solid line in FIG. 2. The leaf spring 11 is at its one end secured to a support member 12 by means of revet 13 while the support member 2 is at its side secured to the front lower wall 14 of the needle bed 2. It should be noted that all the leaf springs are identical in number with the needles and each needle is in engagement with the corresponding one of the leaf springs 11 independently of other needles.

Figures 3, 3A:
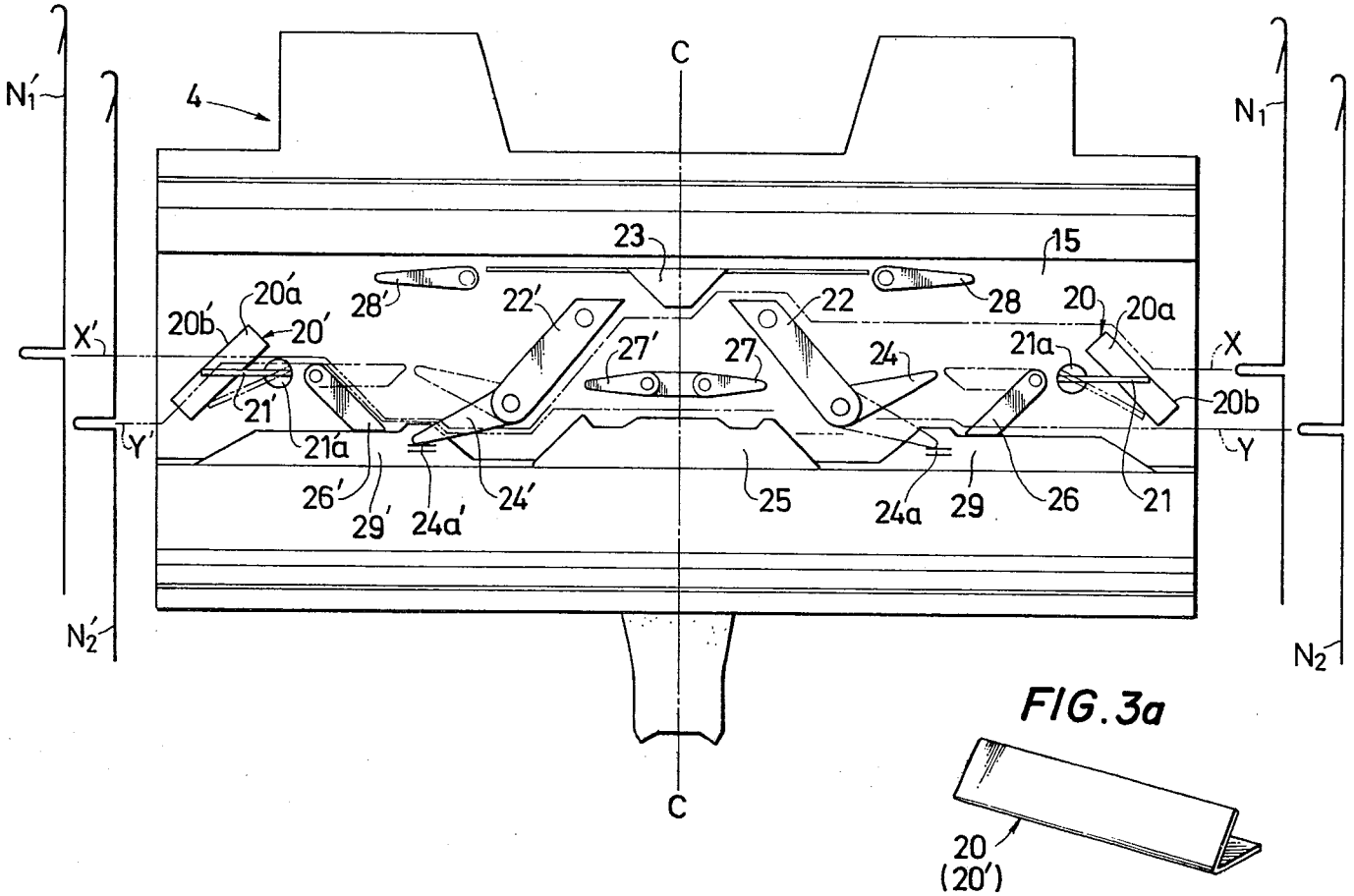
FIG. 3 is a bottom plan view of the actuator according to the invention with a perspective view of FIG. 3*a* of one part of the actuator.

Referring to FIG. 3, various cam tracks are assembled on the under side of a base plate 15 of the actuator 4. Sinker cams 22 and 22′ are the same form and are assembled symmetrically relative to the center line C — C on the base plate 15. Each sinker cam is provided at lower end with a spring operated latch as indicated by the numeral 24 or 24′. A single central cam 23 is interposed between the sinker cams 22 and 22′ to associate with the sinker cams. A pair of selecting cams 20 and 20′ are arranged at both sides of the base plate. The selecting cams are the same shape and assembled on the base plate 15 symmetrically relative to the center line C — C. Each selecting cam is of folded sheet metal form as seen in FIG. 3*a*. The cam face 20*a* is inclined inwardly and backwardly. A pair of spring operated latch 21 and 21′ are the same shape each other and assembled also symmetrically relative to the center line C — C on the base plate. Each latch is of fine rod form and spaced from the base plate so as to be swung about the pivot 21*a* from the solid line position to the dot-and-dash line position against a restoring spring (not shown). A pair of lifting cams or spring operated latches 26 and 26′ are normally spring-biased to the position in the solid line to cooperate with the corresponding selecting cams. Other latches 27 and 27′, and 28 and 28′ are assembled for pivoting various paths to be traced by the needle butts B, but they do not form the invention. Further, the other cam tracks appearing in FIG. 3 and given no numeral also perform cam functions in knitting operations to which the present invention is not directed. The description therefore is hereinafter directly relevant to the operation of the actuator.

For the convenience of readiness in understanding, it is assumed that the actuator 4 was held stationary and the needles were advanced relative to the actuator. It should be noted that parts which are the same as those assembled on the right half of the base plate 15 are given the same number with a prime as seen in the left half of the base plate.

In operation, the needle N1 at the right in FIG. 3 traces the path X — X′ while the other needle N2 traces path Y — Y′ as shown in dot-and-dash lines in FIG. 3. The needle N1 is first lifted by the back cam face 20*b* of the selecting cam 20 and then further lifted by the outer cam face of the sinker cam 22 in successive steps. The needle N1 thereafter reverses the direction of stroke and is sunk in succession by the central single cam 23 and sinker cam 22′ a sufficient distance to form a mesh in the product with the old loop on the needle shank riding over the latch of the latch needle N1 as usual in the conventional machines. The needle N1 further advances past the latch 24′, causing the latch to rotate upward apart from the stopper 24′*a* in the cam track 29′ against a restoring spring (not shown). The needle N1 finally reaches the selecting cam assembly formed of lifting cam 26′ , latch 21′ and selecting cam 20′. The lifting cam 26′ lifts the needle N1 to have the needle subjected to cam function of the selecting cam 20′. The cam face 20′*a* develops a first side thrust against the butt B of the needle N1 to force thereof to sink along Y — Y′ path and a second side thrust to move the butt in the direction normal to the plane of the drawing. Such direction may be understood in FIG. 2 as being toward downward direction in which the needle butt B is depressed as shown in dotted line. In the presence of a sufficient resistance against the second side thrust, the butt follows the path Y — Y′, overcoming the spring operated latch 21′ as shown in the dot-and-dash line. In the absence of such resistance, the needle butt follows X — X′ path. The latch 21′ is sufficiently spring operated in design to remain in the solid line position in such condition against any branch of the second side thrust.

It will be understood from the foregoing that whether the resistance is offered or not against the second side thrust all the needles are divided into two series which follow paths X — X′ and Y — Y′ respectively. This is the important point upon which the device is based. In short, the device according to the invention is enabled to provide means for any selected needles to sufficiently resist against the second side thrust as described hereinafter in greater detail.

Figure 4:
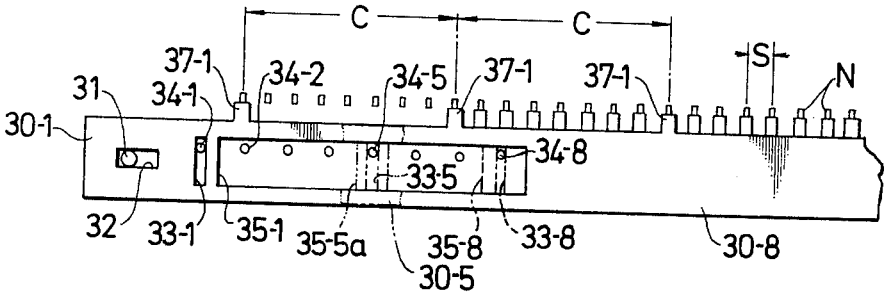
FIGS. 4 and 5 are cross sectional views taken along the line IV — IV in FIG. 7.

Referring to FIGS. 2 and 4, a series of eight selecting sheets 30-1 to 30-8 form the means to cause the needles to resist against the second side thrust. All the sheets are grouped in slidable relation each other and carried by a plurality of pins 31 (FIG. 4) protruding from the back wall 9 of the needle bed 2. Pins 31 are a slide fit in the corresponding elongated holes 32 in the sheets 30. Each hole 32 is so sized as to provide for the sheet sufficient clearance to laterally move one half of the pitch of the series of the needles N. Each sheet has a vertical slot 33 in which a lever 34 is a slide fit. The levers 34 are identical in number with the selecting sheets 30 and engage the corresponding one of them with the end portion slidably penetrated through the slot 33 as shown in FIG. 4 by the numerals 34-1 and 33-1 at the left. For convenience of simplicity of illustration, the frontmost sheet 30-1 is shown in solid line but partially and the other sheets 30-5 and 30-8 are shown in phantom also partially. Between the frontmost sheet 30-1 and rearmost sheet 30-8 are interposed the other sheets 30-2 to 30-7 to build the selecting sheet assembly. The sheet 30-1 has formed with the other large hole 35-1 sufficiently sized to receive therein the other seven levers 34-2 to 34-8 and further permit the sheet to laterally shift half of the pitch of the series of the needles. The sheet 30-8 is formed with similarly a hole 33-8 and a large hole 35-8 except that these holes are located in reverse order as compared with the sheet 30-1. The sheet 30-5 has two large holes 35-5*a* and 35-5*b* at both sides of the small hole 33-5 so that levers 34-1 to 34-4 are received within the hole 35-5*a* and levers 34-6 to 34-8 within the hole 35-5*b* as seen in phantom. From the above description, construction and arrangement respecting to the remaining sheets will be apparent without necessity of further illustration.

Each sheet 30 extends under all the needles and has a series of projections 37 on the upper edge at regular intervals C. The distance C is the center to center distance between two neighboring projections 37 and is eight times as long as the center to center distance between two neighboring needles indicated by the character S in FIG. 4. The reason why the distance C is determined as above is that all the needles are required to be able to face simultaneously to the corresponding projections 37 as shown in FIG. 4. In order to achieve this, the sheets 30 are arranged in a manner such that all the projections are offset exactly one pitch of the needles relative to the neighboring projections of different sheets in successive steps to the arrangement order of the sheets, so that different needles engage different sheets through means of the projections except that the same sheet engages different needles spaced at the same distance as that between the two neighboring projections of that same sheet.

Figure 5:
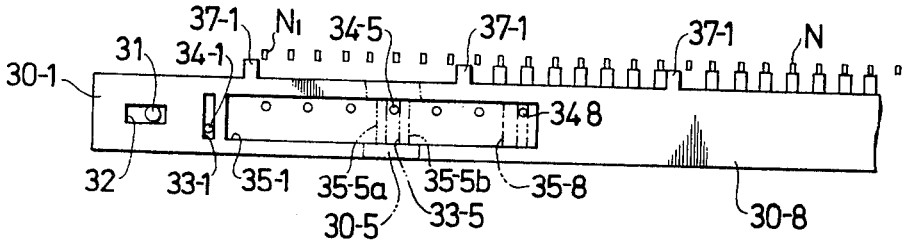

As shown in FIG. 4, all the needles are in engagement with the corresponding projections in the usual mode of operation. In this mode, all the needles are enabled to resist against the aforementioned second side thrust developed from the cam face 20*a* of the selecting cam 20, by restraining them from being depressed downward in FIG. 2. In FIG. 5, the sheet 30-1 is shifted to the left half of the pitch S. All the projections 37-1 of the sheet 30-1 are offset relative to the corresponding needles half the pitch S. Such corresponding needle N1 are unable therefore to resist against the second side thrust and butts of the needles follow the path X — X′ as described in the foregoing.

Figure 6:
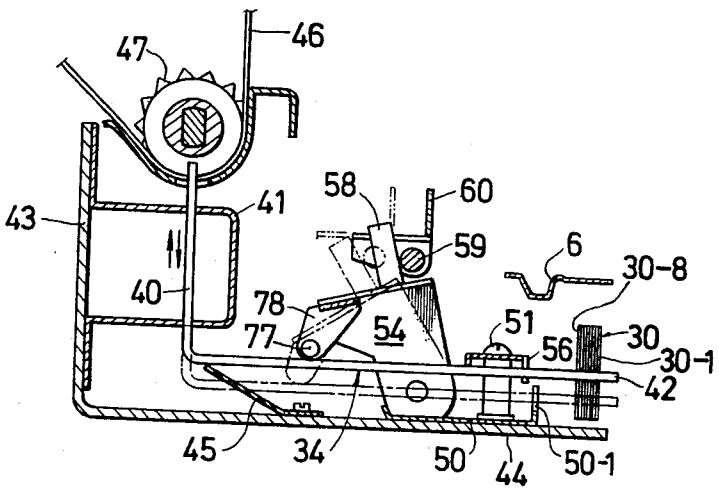
FIG. 6 is a cross sectional view taken along the line VI — VI in FIG. 7.

Referring to FIG. 6, each lever 34 is of L-shaped and the vertical arm 40 thereof is a slide fit in a pair of holes in a U-shaped frame 41 as seen in the view. The other arm 42 of the lever 34 is at its end engaged with the corresponding sheet 30. The U-shaped frame 41 is secured to the upright rearmost wall 43 of the extending portion from the bottom sheet metal 44 of the needle bed 2. The horizontal arm 42 of each lever 34 is normally urged to the solid line position by a leaf spring 45. The leaf spring 45 is of forked form and the branches are identical in number with the levers 34, namely eight branches. Each branch engages corresponding lever 34 idependently of the other levers.

The uppermost extremity of the arm 40 of each lever is engageable with a punched card or tape 46 carried on a roll 90 and advanced by a sprocket 47. As shown at the upper left of FIG. 1 and at the upper left of FIG. 7, the card 46 is perforated in accordance with any pattern in the character of the product which is needed. Possibility of upright movement of the arm 40 is governed by the perforation in the card 46. In the absence of the hole at the position just adjacent to the extremity of the arm 40, the lever 34 is not permitted to rise beyond the level of the punched card 46. In the presence of the hole at such position, the lever is permitted to rise beyond the level.

Figure 8:
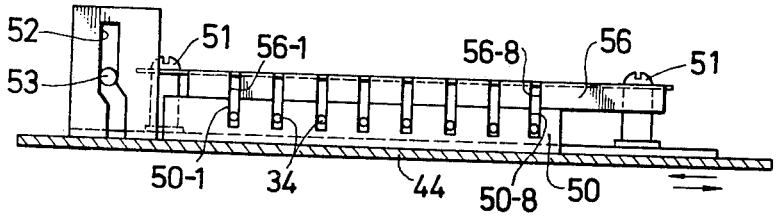
FIGS. 8 and 9 are cross sectional views taken along the line VIII — VIII in FIG. 7.

Referring to FIG. 6, a shifting member 50 is slidably mounted on the bottom plate 44 of the needle bed 2, being guided along the direction normal to the plane of the drawing, namely along the direction indicated by the arrows in FIG. 8. In FIG. 8, a pair of spaced pins 51 is upward projecting from bottom plate 44 of the needle bed 2. The shifting member 50 has a pair of elongated holes (not shown) in its horizontal portion in which the pins 51 are a slide fit respectively. As shown in FIG. 8, the sheet 50 is formed with a cam groove 52 in the upright portion. A roller 53 engaging the cam groove 52 extends from a rocking member 54. As shown in FIG. 10, the rocking member 54 is of inverted U-shape and both feet are pivoted to the bottom plate 44 by pivot pins 55. Returning to FIGS. 8 and 9, at the top of the pins 51 is secured a guide member 56 of comb like form having a series of eight grooves 56-1 to 56-8 at regular intervals. The shifting member 50 is also formed with a series of grooves at identical intervals with the guide member 56 as indicated by the numerals 50-1 to 50-8.

Figure 9:
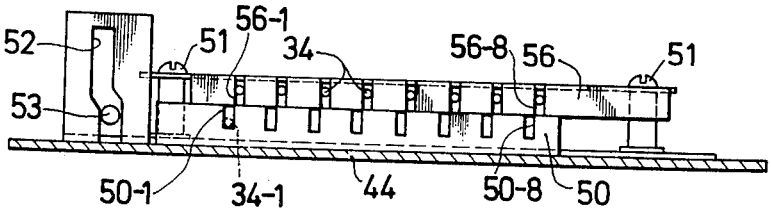
Figure 10:
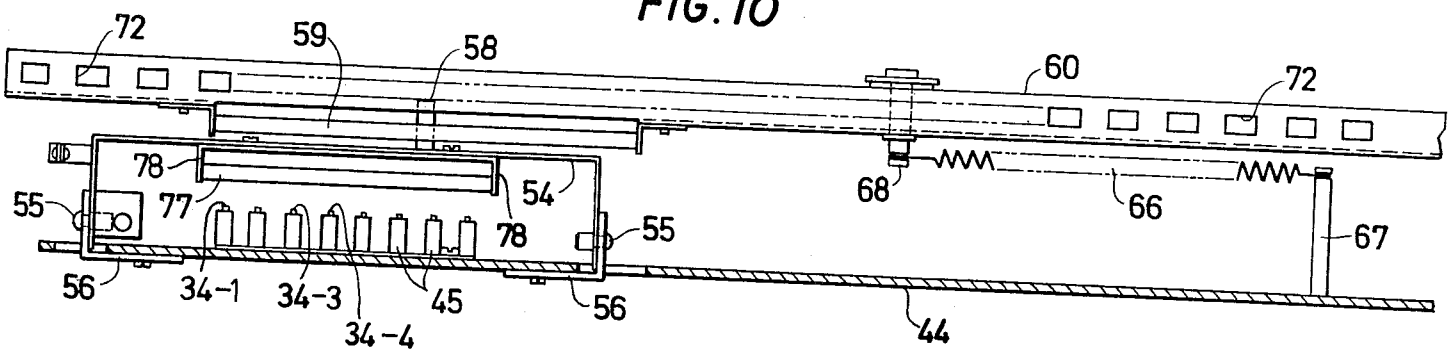
FIG. 10 is a cross sectional view taken along the line X — X in FIG. 7.
Figure 11:
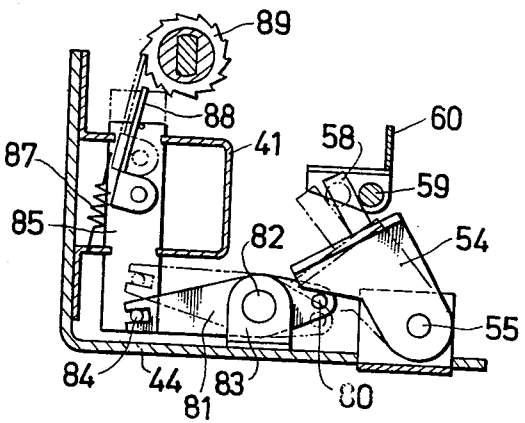
FIG. 11 is a cross sectional view taken along the line XI — XI in FIG. 7.

As shown in FIG. 9, all the levers 34 are held in the grooves 56-1 to 56-8 by the shifting member 50 which is in the left and shifted position. In FIG. 8, the shifting member 50 is in the right hand position and all the grooves 50-1 to 50-8 are, in location, consistent with the grooves of the guide member 56 respectively. The levers 34 are accordingly permitted to be lowered down into the grooves of the shifting member 50 as seen in the view. In the position of FIG. 8, all the levers 34 may be leftward shifted by shifting member 50 to the left. The leftward movement of the member 50 is effected by the cam function of the cam groove 52 and roller 53. The cam function results from rocking motion by the rocking member 54 as shown in FIGS. 6, 11 and 2. The member 54 has on the horizontal portion thereof an upright pin 58 which is engageable with the drive means as hereinafter described in greater detail. In FIG. 2, the rocking member is normally urged to the position shown by a coiled spring 73 anchored at both ends to a pin 74 on the member 54 and a pin 75 secured to the bottom plate 44.

As above stated, all the levers 34 are leftward shifted by leftward shifting the shifting member 50 in the condition of FIG. 8. The leftward movement of the levers 34 in FIG. 8 results in their swinging motion about their upright arm 40 shown in FIG. 6. Such swinging motion further is transmitted to the selecting sheets 30 to cause them to shift in the direction normal to the plane of the drawing of FIG. 6, namely to the left in FIG. 5. Although all the levers 34 are in the grooves in the shifting member 50, any of them may be permitted to get out of such grooves and get into the corresponding grooves in the upper member 56 if there exists a hole to penetrate therethrough in the punched card 46 as shown in solid line in FIg. 6, for the upright arm 40. Such transfer of the lever 34 is governed by whether or not a hole to penetrate exists in the card 46 for the arm 40.

In order to achieve the governing as above mentioned, the device is further provided with a clearing bar 77 as shown in FIG. 6. When the rocking member 54 is wung to the left in FIG. 6, the bar, which extends above all the levers 34, will press down levers 34 which are retained in the upper position to join with the other levers 34 which remain in the lower dot-and-dash line position in FIG. 6. When the rocking member 54 reverses the direction of rocking, the bar 77 releases all the levers to permit upward movement. Immediately prior to this release, the card 46 is advanced one pitch of the series of signals in the card against the subsequent selecting operation of the device. The bar 77 is secured to the rocking member 54 through means of inverted U-shaped holder 78 as best shown in FIG. 10.

Figure 7:
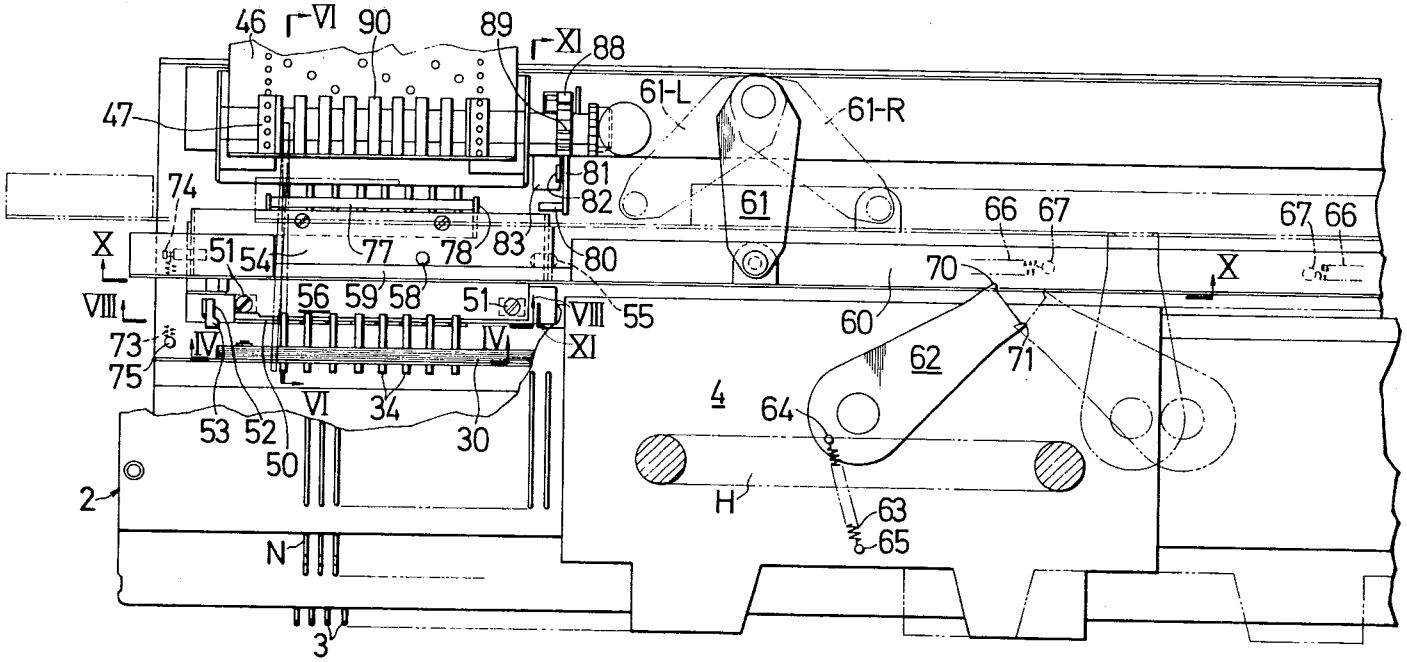
FIG. 7 is a plan view of the machine of FIG. 1 partially showing in enlarged scale.

As best shown in FIG. 1, a connecting link 60 and a pair of identical levers 61 form a multiple lever mechanism together with the U-shaped holding member 41. In order to normally urge the multiple lever mechanism to the position shown in solid line, a pair of coiled tensioned springs 66 are provided with both ends thereof anchored to a pin 68 secured to the link 60 and to the base plate 44 by means of a pin 67 as seen in FIG. 10. In order to move the bar or link 60, there is provided a swinging pawl 62 pivotally mounted on the carriage 4 as shown in FIGS. 1 and 7. A restoring spring 63 is anchored at one end to a pin 64 on the pawl 62 and at the other end to a pin 65 on the actuator 4. The pawl 62 is normally urged to a neutral position (not shown) in which pawl 62 is normal to the link 60. The pawl is spring biased, in the rest position, toward inclined relation relative to the link 60 with one free end (in this case end 70) pivotally engaging one of serially arranged holes 72 in the link shown in FIG. 10. In the reverse travel of the actuator 4 pawl 62 engages the link at the other end 71 as shown in phantom in FIG. 7.

Each time the actuator reverses the direction of travel, the link 60 is moved in the same direction as the actuator and also backwardly. The pawl 62 swings through an angle between two positions as shown in solid lines and in phantom in FIG. 1, with the levers 61 swung between 61-R position and the neutral position, during the first half of swing of pawl 62. During the subsequent second half of the swing of the pawl, the link returns to the left until the lever returns to the neutral solid line position, a constant reciprocating motion being performed by the link 60 each time the actuator reverses the direction of stroke on the needle bed 2. A reversal takes places when the actuator subsequently reverses the direction of the stroke oppositely to the above mentioned direction and in this stroke the lever 61 swings oppositely through the angle between the neutral position and position 61-L as shown in FIG. 7.

As seen in FIG. 10, the link 60 has on the lower left side a bar 59 against which the pin 58 of rocking member 54 is spring biased toward abutment. The link 60 performs one cycle of reciprocation between two positions as shown in FIG. 2, each time the actuator reverses direction of travel on the needle bed. It will be noted accordingly that the selecting device of the machine according to the invention is driven each time the actuator reverses the direction of the stroke.

In FIG. 11, means to intermittently transfer the card 46 is shown. The rocking member 54 is abutment engagement relation with a pin 80 projecting on one end of a lever 81 which is pivotable on a pin 82 of the bracket 83 secured on the bottom plate 44. The other forked end of lever 81 engages a pin 84 on the vertically reciprocable member 85 which is a slide fit on the U-shaped holder 41 and spring operated to normally upward move by a restoring spring 87. A pawl 88 is normally resiliently in engagement relation with a ratchet wheel 89 mounted on the shaft together with sprocket 47 and grooved roller 90. From the foregoing it will be understood that the ratchet wheel 89 is rotated one pitch of the series of signals in the card 46 during the first half of rocking motion of the rocking member 54.

For convenience of understanding, the following description summarizes the operation of the device of the machine, particularly the timed relation between the aforementioned various parts of the embodiment.

Referring to FIG. 3, the needles N1 and N2 at the right occupy the non-selected position and selected position respectively. This is achieved during the precedent knitting travel of the actuator by subjecting the needles to the selecting cam 20. It should be noted that resultant selection of the needles is effective in the subsequent knitting travel of the actuator. Further, it should be noted that the symmetrical arrangement of the various cam tracks causes the actuator to be effective in either direction travel on the needle bed.

During the first half of one cycle of rocking by the rocking member 54, the following steps are performed in successive steps to an increasing degree of angle.

Shifting member 50 is first moved from the position of FIG. 9 to the right, to the position of FIG. 8. All the slots 50-1 to 50-8 accordingly become consistent with the corresponding slots of the upper member 56 which is stationary.

The clearing bar 77 then presses down any levers 34 which occupy the upper non-selecting positions with the upright arm 40 penetrating the corresponding holes in the card 46. All the levers 34 are forced lowered in the slots 50-1 to 50-8 as seen in FIG. 8. Just immediately after this, the rocking member 54 drives the card advancing mechanism shown in FIG. 11 and the card 46 is advanced one pitch of the series of signals. The rocking member 54 then reverses the rocking direction and the clearing bar 77 releases all the levers 34. In the absence of the corresponding hole in the card, any lever 34 remains lowered and in the presence of the corresponding hole any lever returns upward as shown in FIG. 9 (all the levers upward returned in this case). As the rocking member 54 reverses direction of rocking as shown in FIG. 6, the roller 53 (FIG. 8 and FIG. 9) in the cam groove 52 accordingly moves downward from the position of FIG. 8 to the position of FIG. 9. The shifting member 50 is accordingly shifted to the left. Assuming that lever 34-1 remains lowered in the groove 50-1 as shown in phantom in FIG. 9, the lever 34-1 is also trailed to the left by the member 50. Referring to FIG. 6, the trailing of the lever is translated into swing motion thereof about the upright arm 40 the extremity end of which is in abutment relation to the card 46 in the absence of a hole to be penetrated thereby in the card (FIG. 6). It should be noted that clockwise swing motion of the rocking member 50 is derived from the restoring spring 73 of the rocking member 54 and the second returning stroke of the link 60 is derived from the pair of restoring springs 66 (FIG. 10).

Upon returning of both link 60 and rocking member 54 to their original positions, one cycle of selecting operation is thus completed and the resultant effect is used during the immediately subsequent reverse travel of the actuator.

Although the needles N2 were described as being unable to perform knitting function because of the shorter lift and sinking, the present invention is not restricted to this. A modification may be allowed to cause the needles N2 to perform knitting operation by giving them a suitable length stroke of axial movement. Further, a knitting yarn of different type may be employed to be supplied to the selected needles N2 through means of usual yarn guide separately located apart from the main yarn guide (not shown). The present invention is contemplated to provide means beneficially applicable also to such modifications.

In FIGS. 12 to 17 are shown the second embodiment of the invention. Parts which are the same as those shown in FIGS. 1 to 11 are given the same number in a 200 series. The duplicated description will therefore be unnecessary. Such designation will be broadened to the extent that parts which are functionally the same as those in FIGS. 1 to 11 but structurally different, are included therein.

Figure 12:
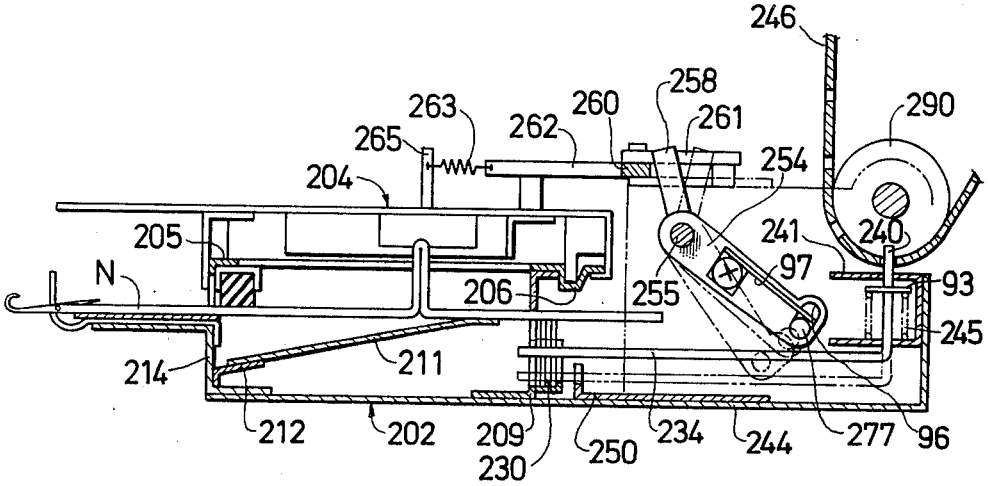
FIG. 12 is a view similar to FIG. 2 showing the second embodiment according to the invention.

Referring to FIG. 12, each L-shaped lever 234 is formed with on the upright arm 240 a flanged portion 93. A restoring compressed spring 245 is interposed between the flange 93 and the lower wall of laid U-shaped holding member 241 for normally urging the arm 240 toward engagement with the card 246. The rocking member 254 is formed with an elongated hole 96 at the free end of both arms, in which is a slide fit the clearing bar 277. The clearing bar 277 is further normally spring biased to the bottom end of each elongated hole 96 by a leaf spring 96, as shown in FIG. 12. The provision of the leaf spring 97 is a contemplation to provide means for permitting the rocking member 254 to rock excessively after the lever 234 reached the lowermost end of its stroke. The excessive stroke obtained with this arrangement is of sufficient duration to permit the rocking member 254 to swing to drive the drum 290 for advancing card 246 one pitch of the series of signals. Readiness in design is expected by such arrangement.

Figure 13:
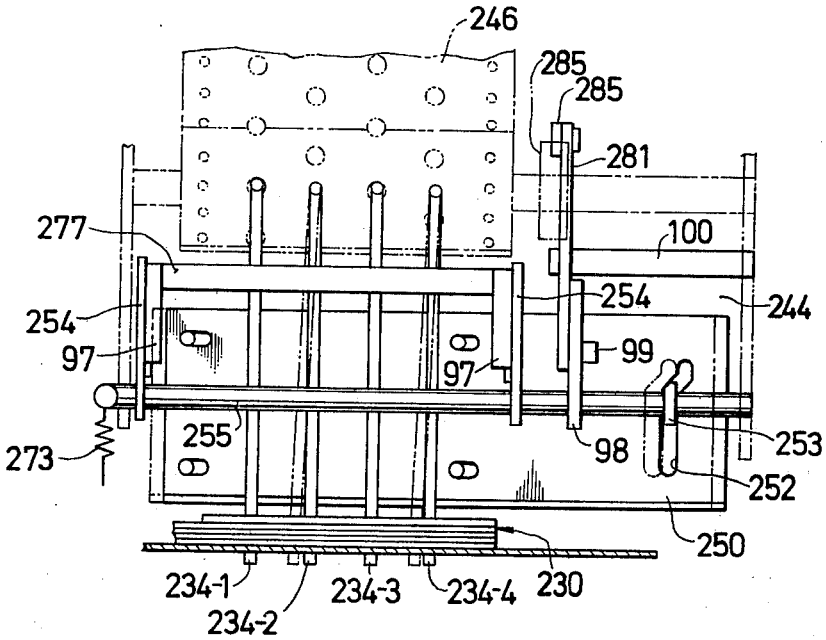
FIG. 13 is an enlarged scale plan view partially showing the second embodiment.
Figure 14:
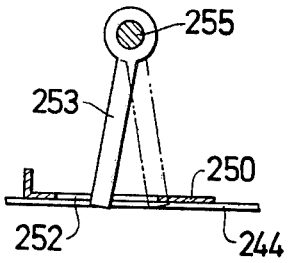
FIGS. 14 and 15 are views showing respectively parts of the embodiment of FIG. 12.
Figure 15:
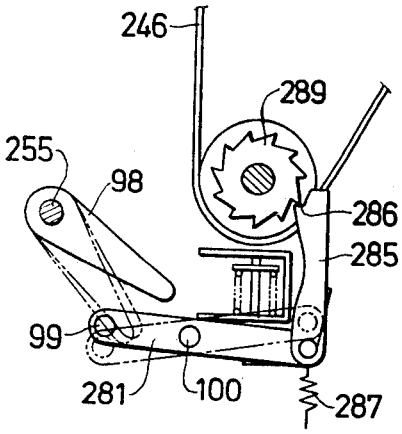

Referring to FIG. 13, the rocking shaft 255 is provided with an arm 253 in integral therewith. The extremity of the arm 253 engages cam groove 252 in the shifting member 250. Clockwise rocking of the member 254 in FIG. 12, causes the arm 253 to shift the plate 250 from dot-and-dash line position to the solid line position in FIG. 13. As shown in FIG. 13, the shaft 255 is provided with an arm 98 in integral therewith. The end of the arm 98 is engageable with the middle lever 281 through a pin 99 thereof. In FIG. 15, the lever 281 is pivotally supported on the pin 100 secured on the bottom plate 244 of the needle bed 2 and rotatably connected with an upright link 285. The paw 286 serves to rotate ratchet wheel 289 one pitch of the series of signals in card 246 each time link 285 is upward moved by the arm 98 through middle lever 281.

Figure 16A:
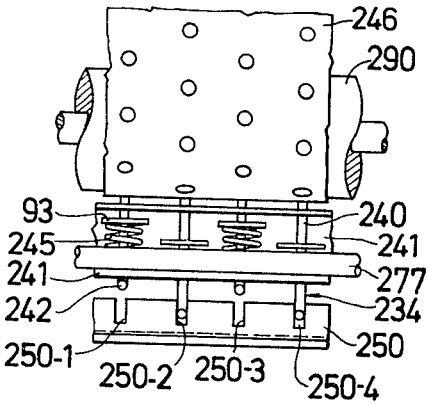
FIGS. 16*a*, 16*b*, 16*c* are partial views of the second embodiment showing operation of the embodiment.
Figure 16B:
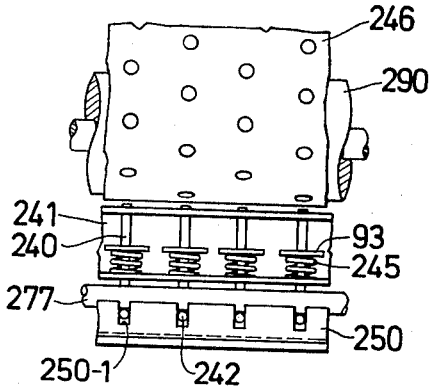

In operation of the second embodiment, change of steps of the operation is completely the same as that of the first embodiment. In the first half of the rocking cycle of the rocking member 254, the shifting plate 250 is first shifted toward the right in FIG. 13 from the dot-and-dash line position to the solid lines position through means of the arm 253 (FIG. 14) which swings in timed relation with other associating parts from the dot-and-dash line position to the solid line position. Four vertical slots 250-1 to 250-4 according occupy exactly the original positions under the lever 234 as seen in FIg. 16*a* so that every lever 234 is downward shiftable into the corresponding slots 250-1 to 250-4 in the shifting plate 250, by clearing bar 277 as shown in FIG. 16*b*. In such downward movement the leaf springs 97 (FIG. 12) overcome all the coil springs 254 until the levers 234 reaches the bottom ends of the slots 250-1 to 250-4. Further clockwise swing of the rocking member 254 causes the drum 290 to rotate one pitch of the signals in the card, while leaving the clearing bar 277 and levers 234 lowered in the dot-and-dash line position in FIG. 12.

Figure 16C:
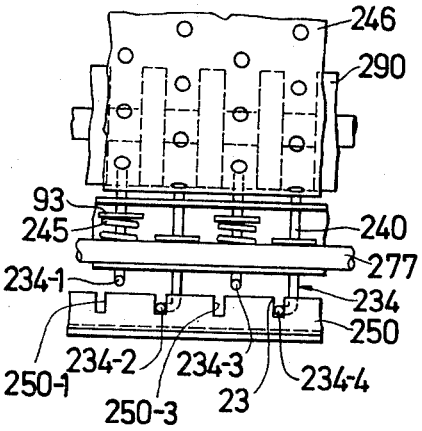

The rocking member 254 then reverses the rocking direction to return to the solid line position in FIG. 12. The bar 277 accordingly releases all the levers 234. The levers 234-1 and 234-3 follow the bar 277 to return upward as seen in FIG. 16*c* out of the corresponding slots 250-1 and 250-3, in the presence of corresponding holes in the card. The other levers 234-2 and 234-4 remain downward, in the selected positions, in the absence of the corresponding holes in the card.

Further rotation of the member 254 causes the shifting plate 250 to the left in FIG. 13 as shown in dot-and-dash line. The levers 234-2 and 234-4 are trailed leftward by the sheet 250 as seen in FIG. 16*c*.

Figure 17:
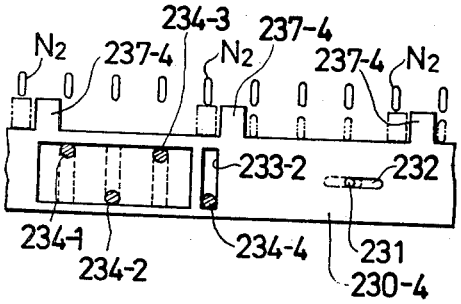
FIG. 17 is a view showing essentially parts of the control means of the second embodiment.

The levers 234-2 and 234-4 accordingly trail the corresponding selecting sheets 230-2 and 230-4. In FIG. 17, it will be seen that the needle N2 are restrained from downward movement by the corresponding projections 237-4 of the selecting sheet 230-4, as shown by the dot-and-dash line. The same takes places with the other selected plate 230-2.

In FIGS. 18 to 21 is shown the third embodiment. Parts which are the same as those shown in FIGS. 1 and 17 are given the same members in a 300 series. The duplication in description may be eliminated accordingly.

Figure 18:
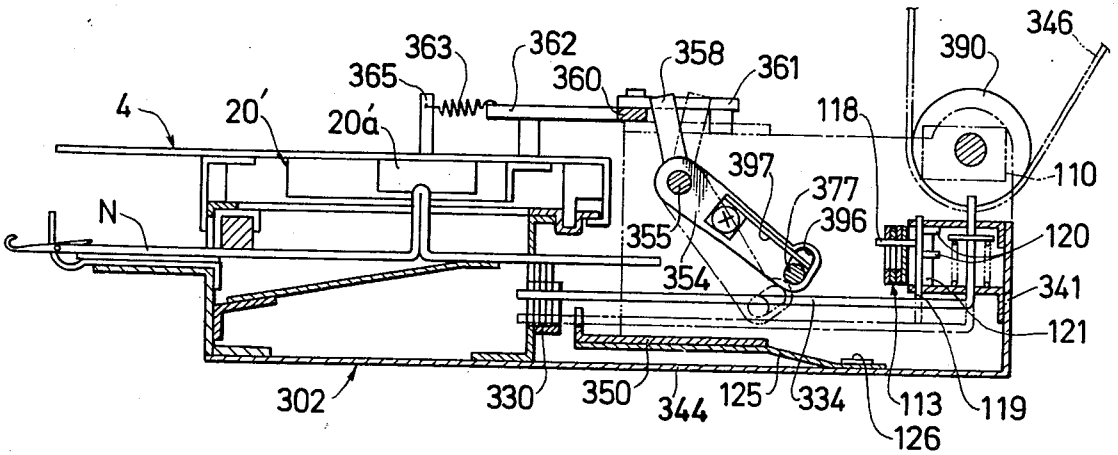
FIG. 18 is a side view similar to FIG. 2 showing the third embodiment according to the invention.

In FIG. 18, the embodiment is equipped with manually operating selecting means 110 in the type of push button. The third embodiment is equivalent to the second embodiment except the manually operable means, which is hereinafter described in greater detail. Each push button 110 carries on the stem 111 a pin 112. A series of four cam plates 113-1 to 113-4 are supported in slidably contacting relaton to each other at the front side of the supporting holder 341 secured to the back wall of the needle bed 302. Each cam plate 113 is formed with a pair of spaced cam grooves 115 and 117. The pin 112 of each push button engages the groove 117. By pushing down the push button 110-1 the cam plate 113-1 is shifted to the right in FIG. 19, because of engagement of the latter with push button 110-1 through means of the pin 112-1 and groove 117-1. In order to permit such shifting, each cam plate 113 is formed with a plurality of elongated holes 116 (only one is shown in the view) in which is a slide fit a in 130 secured to the front side wall of the holding member 341 (FIG. 18). The cam plates are formed with an additional hole 114 to provide sufficient clearance for the pins 112 which extend from the other push buttons to shift.

The other cam groove 115-1 in the cam plate 113-1 engages a pin 118-1 projecting from one of a series of transmitting member 119. The series of four transmitting member 119 are vertically slidably supported by a pair of spaced pins 120 (FIG. 18) projecting therefrom and being a slide fit in a corresponding vertical groove 121 in the front wall of the holding member 341. The cam plate 113-1 is still further formed with a large hole 122 to provide a sufficient clearance for the other pins 118-2 to 118-4 which engage the other corresponding cam grooves 115-2 to 115-4 of respective cam plates 113. Each transmitting member 119 is contact engagement with the corresponding levers 334.

Figure 20:
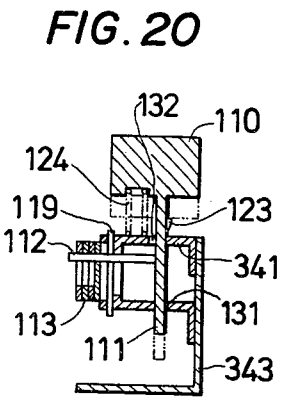
FIG. 19 to FIG. 21 are views showing respectively parts of the embodiment of FIG. 18.
Figure 21:
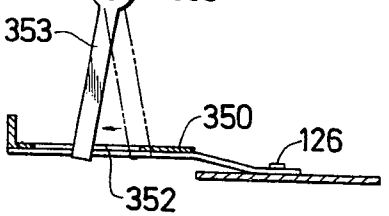
Figure 19:
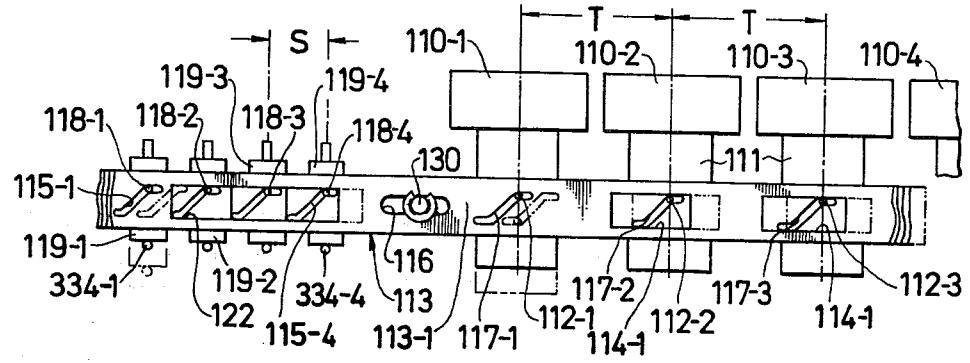

When any push button is pushed down, the corresponding cam plate is shifted to the right in FIG. 19 through the cam assembly of groove and pin. As a result, the corresponding transmitting member 119 is then shifted downward to thereby push down the corresponding lever 334 as seen in phantom in FIG. 18. In order to keep the lever 334 in the lowered position each push button 110 is provided with tooth 123, as shown in FIG. 20, and a coiled compressed spring 124. The stem 111 of each button is vertically slide fit in the corresponding hole 131 in the bottom wall of the member 341 and a vertical and lateral slide fit in the other hole 132 in the upper wall. As a result the spring 124 is normally apt to urge the push button stem 111 to upward and clockwise direction. With this arrangement, the push buttons 110 are enabled to remain lowered with spring 124 urging the tooth 123 on the stem to the under side face of the upper wall of the member 341. Question may be raised as to why the push buttons are rquired to be locked in the lowered positions by the tooth 123 and the associating parts. The reason is that for fear of erroneous selection of the button, the resultant selection should be of sufficient duration to permit such selection to be under the observation of the operator until the subsequent selection is performed. The push buttons may be restored to the position shown by slightly counterclockwise pushing the upper end against spring 124 to disengage tooth 123 from the upper wall.

By pushing any button, the corresponding transmitting member 119 is also lowered and the corresponding lever 334 is in turn passed down as shown in phantom in FIG. 18. The shifting plate 350 which receives the lever 334 in the corresponding groove is secured to a holding member 125. The member 125 is in turn laterally slidably mounted on the bottom plate 344 by means of elongated holes in which are a slide fit pins 126 secured to the bottom plate 344.

In the manual mode of operation, any push button is pushed down also each time the actuator is in the position in which the actuator is immediately prior to initiating the reverse travel. In this stage, at least one of the selecting plate 330 is held in the selected position and the shifting sheet 350 in turn still remains in the shifted position. In such condition, any lever 334 to be pushed down is offset half of one pitch of the slots in the member 350 relative to the corresponding one of the slots. Such lever is bent down restorably, subject to the pushing down by the transmitting member 119. The bending however ceases immediately after shifting plate 350 is oppositely shifted half of the pitch and the corresponding slot returns to its original position just adjoining to which the bent lever remains stationary in the other slot of a stationary guide member (not shown) similar to the guide member 56 of the first embodiment. As a result, the bent lever enters into the corresponding slot. The subsequent steps of operation will be apparent from the operation of the first and second embodiments with respect to which description has been made in greater detail in the foregoing.

It is noted from the foregoing that the push buttons are operable independently of the punched card 46 and the associating parts so that control by the push button may be supplemented to the controlling action by the punched card.

For convenience of simplicity, the aforementioned guide member which is similar to the guide member 56 in the first embodiment has ben abbreviated from the description as to the third embodiment. Such member is usually employed in the practice of the invention to exactly hold the levers in their awaiting position though does not form the invention.

What is claimed is:

1. A hand knitting machine having a needle bed, a series of sinkers forwardly extending from the front extremity of the needle bed and arranged in parallel with each other and at regular intervals in a plane, a series of latch needles alternating with the sinkers and having a slide fit on the needle bed so as to project beyond the retract behind the neighboring sinkers, an actuator movably supported on the needle bed so as to reciprocate along the longitudinal direction thereof, said actuator including a base plate, a plurality of cam means assembled on the base plate to form cam tracks to guide the latches of said latch needles upon reciprocating movement of the actuator, and a needle selecting means including a series of needle selecting sheets extending under all the needles and laterally shiftable for selecting the needles between the operative and inoperative positions, said needle selecting sheets being formed with a series of projections at identical intervals with those of the needles on one side edge thereof for engaging the needles, control means provided on the needle bed for controlling the movement of the needle selecting sheets, and drive means operatively connected to said control means for actuating the same only when said actuator reverses the direction of travel along the needle bed, whereby said control means is actuated to laterally shift the needle selecting sheets for selecting the needles between the operative and inoperative positions.

2. A hand knitting machine as claimed in claim 1 wherein, said drive means comprises a bar means extending throughout entire stroke of the actuator and movably supported on the needle bed either in the longitudinal or transverse direction of the needle bed against a restoring spring, and a pawl pivoted to the actuator with the free end thereof normally spring biased toward abutment against the bar in oppositely inclined two positions relative to the bar, and latchet means formed on the bar for engaging the free end of the pawl, said bar being operatively connected to the control means, whereby the bar is only capable of being driven by the actuator through the pawl at the beginning of every stroke of the actuator for a short period until the pawl reverses the inclination thereof relative to the bar to be in the idling position on the latchet means.

3. A hand knitting machine as claimed in claim 2 wherein said drive means comprises a pair of longitudinally identical levers pivoted to the needle bed and rotatably connected together at the free ends thereof by said bar as a link to form a parallelogram lever-and-link mechanism with the bar normally remaining parallel to the stroke of the actuator, said restoring spring normally urging the lever-and-link mechanism to a rectangular position.

4. A hand knitting machine as claimed in claim 2 wherein said control means of the needle selecting means comprises a punched card carried on a roll to be advanced each time the actuator reverses direction of the travel on the needle bed, a series of levers identical in number with said needle selecting sheets and operatively connected with the corresponding sheets at one end while being enabled to move relative to the said punched card with expectation that the levers may be or may not be permitted to further move relative to the punched card in the presence or absence of the signal in the card respectively, a reciprocating member which reciprocates each time the actuator reverses direction of travel and has a series of engaging portions identical in number with the levers and releasably engageable with the said corresponding levers, and clearing means which moves each time the actuator reverses direction of travel toward all the levers to thereby force all the levers into the corresponding engaging portions and subsequently release to release from the engaging portions in response to signals in the punched card.

5. A hand knitting machine as claimed in claim 4 wherein, each of said needle selecting sheets is formed with a slot in which the lever has a vertical slide fit and each lever has an upright arm, each upright arm being reciprocably supported relative to the punched card.

6. A hand knitting machine as claimed in claim 4 wherein, the control means further includes additionally a series of push buttons, a series of cam plates, and a series of vertically movable transmitting members, each cam plate having a cam groove engaging the corresponding push button and another cam groove engaging the corresponding transmitting member, each transmitting member being disposed immediately above the corresponding lever, the reciprocating means being disposed under all the levers.

7. A hand knitting machine as claimed in claim 6 wherein, said push buttons are arranged at regular intervals being of such a length as to prevent a human finger end from pushing down any neighboring push button inadvertently.

8. A hand knitting machine as claimed in claim 7 wherein, said transmitting members are arranged at regular intervals of lesser length than that of said push buttons for permitting usual assembling with the associated part of the hand knitting machine.

* * * * *